US007614969B2

(12) United States Patent
Meyer et al.

(10) Patent No.: US 7,614,969 B2
(45) Date of Patent: Nov. 10, 2009

(54) STICKS FOR ATHLETIC EQUIPMENT

(75) Inventors: Rene P. Meyer, Livermore, CA (US); Scott D. Paterson, Pleasanton, CA (US)

(73) Assignee: Hammer Sports Inc., Pleasanton, CA (US)

( * ) Notice: Subject to any disclaimer, the term of this patent is extended or adjusted under 35 U.S.C. 154(b) by 278 days.

(21) Appl. No.: 11/460,973

(22) Filed: Jul. 29, 2006

(65) Prior Publication Data

US 2007/0049431 A1 Mar. 1, 2007

Related U.S. Application Data

(60) Provisional application No. 60/710,643, filed on Aug. 23, 2005, provisional application No. 60/716,911, filed on Sep. 14, 2005.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS 3,702,702 A * 11/1972 Hoult ..... 473/513
3,876,204 A * 4/1975 Moore et al. ..... 473/520
4,032,143 A * 6/1977 Mueller et al. ..... 473/567
4,037,841 A 7/1977 Lewis, Jr.
4,671,508 A * 6/1987 Tetreault ..... 473/457
4,739,994 A 4/1988 Lewis, Jr.
5,333,857 A * 8/1994 Lallemand ..... 473/561
5,556,677 A 9/1996 Quigley
5,688,571 A 11/1997 Quigley et al.
5,888,601 A 3/1999 Quigley et al.
6,129,962 A 10/2000 Quigley et al.
6,361,451 B1 3/2002 Masters et al.
6,702,697 B1 3/2004 Lussier
6,752,730 B1 6/2004 Brine, Jr.
6,767,299 B1 * 7/2004 Chang ..... 473/564
6,939,257 B2 * 9/2005 Tiitola ..... 473/561
7,147,580 B2 * 12/2006 Nutter et al. ..... 473/457
2004/0116217 A1 6/2004 Morrow
2004/0248675 A1 * 12/2004 Brock et al. ..... 473/457
2005/0096159 A1 * 5/2005 Houston et al. ..... 473/513
2005/0153799 A1 7/2005 Rigoli
2005/0272521 A1 12/2005 Tsai
2005/0277494 A1 * 12/2005 Goss ..... 473/513

(Continued)

FOREIGN PATENT DOCUMENTS

CA 2231908 9/1999

(Continued)

*Primary Examiner*—Gene Kim
*Assistant Examiner*—M Chambers
(74) *Attorney, Agent, or Firm*—Aka Chan LLP

(57) ABSTRACT

An elongated shaft has a shock-absorbing core, a fiber-reinforced durable plastic outer skin encasing the core, and an elongated stiffening member encased within the core. The elongated stiffening member may be a spar or a hollow tube. If it is a hollow tube, the tube may contain a weight that moves along the inside of the tube as the shaft is swung. The shaft also has a way to attach athletic equipment, such as a lacrosse head frame and net, to one end.

12 Claims, 14 Drawing Sheets

U.S. PATENT DOCUMENTS

| | | | | |
|---|---|---|---|---|
| 2006/0009318 | A1* | 1/2006 | Hayden et al. | 473/513 |
| 2006/0046866 | A1 | 3/2006 | Rigoli | |
| 2007/0004541 | A1* | 1/2007 | Price et al. | 473/513 |

FOREIGN PATENT DOCUMENTS

| | | |
|---|---|---|
| CA | 2509254 | 12/2005 |
| DE | 19832542 | 2/2000 |
| GB | 2306335 | 5/1997 |
| WO | 9920357 | 4/1999 |
| WO | 0127244 | 4/2001 |

* cited by examiner

STICKS FOR ATHLETIC EQUIPMENT

CROSS-REFERENCE TO RELATED APPLICATION

This invention claims priority from provisional applications Nos. 60/710,643 and 60/716,911, filed Aug. 23, 2005 and Sep. 14, 2005, respectively, by Rene P. Meyer and Scott D. Patterson.

BACKGROUND OF THE INVENTION

This invention relates to a stick having a shaft to which various pieces of athletic equipment can be attached. In particular, it relates to a lacrosse stick having a shock-absorbing core, a durable outer skin encasing the core, and a stiffener encased within the core, and a mounting plate for attaching a lacrosse head frame and net to one end of the shaft.

Lacrosse is a game that originated with the American and Canadian Indians. The game requires a stick to which is attached a small net for catching and throwing a ball. The sticks were originally hand-crafted of wood, usually of hickory, but they lack uniformity as to quality, strength, weight, and feel in the hands of a player. Many modern lacrosse sticks are made of metal alloys and plastic composites. They are lighter and more uniform than wood, but some of their properties, such as vibration damping, impact absorption, strength, and balance, are not are good as players desire. As a result, they produce unwanted vibration, transfer impact shock to the user, and may break, leaving jagged ends that may injure themselves and other players.

SUMMARY OF THE INVENTION

We have invented a stick for use in playing various sports that overcomes many of the deficiencies of prior sticks. The stick comprises a shaft to which various pieces of athletic equipment can be attached. It has a skin of hard composite resin over a soft foamed plastic core encasing a stiffener. The unique construction of the stick reduces its weight, increases its safety, and improves its behavior when used in playing sports.

The foamed plastic absorbs shocks and the skin and stiffener provide additional rigidity to the stick. By using a hollow tube as a stiffener, a fixed or moveable weight may be positioned within the hollow tube to enable the user to increase or decrease the weight and/or its position along the tube. A mounting plate at the end of the shaft is provided so that various types of athletic equipment may be attached to the end of the shaft.

The shaft of this invention is significantly more flexible shaft than the widely available commercial hollow metal or composite tube designs, and the increased flexibility improves safety for the players. For example when a player knocked to the ground has one end of a stick supported by his body with the other end on the ground, and another player falls on the stick, both players benefit from the diminished force applied to their bodies by the more flexible stick.

When a stick is stressed to breaking failure, it is desirable to have the failure point not present sharp edges capable of cutting a player. The composite stick of this invention minimizes sharp jagged edges and, when bent to the point of breaking, the skin collapses while the supporting core safely compresses. Commercial hollow metal and composite tube sticks, on the other hand, present sharp points at each side of the fold when bent to folding and, in the case of strong alloys, metal spall has occurred. In one case, a $3/16^{th}$ by ½ inch long piece was forcefully ejected from the surface, hitting the test engineer's face shield. Since players do not generally wear eye protection spall could present an eye damage hazard.

During lacrosse play, stick-on-stick impact is common, which shocks the hands of the players. Repetitive shocking can lead to injury. The sticks of this invention dampen the shock much more than the commercial hollow tube designs.

DESCRIPTION OF THE PREFERRED EMBODIMENTS

Figure 1:
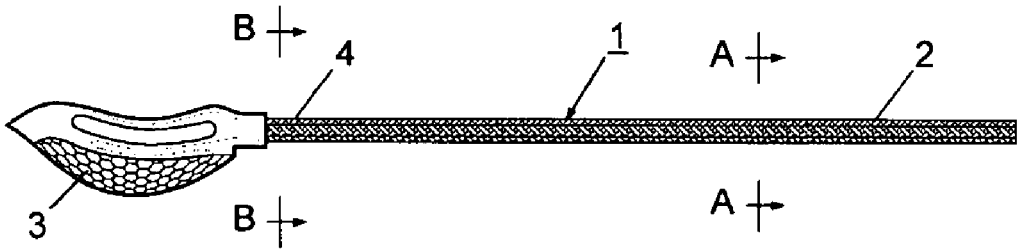
FIG. 1 is a side view of a certain presently preferred embodiment of a lacrosse stick according to this invention that has a spar-stiffened shaft.

In FIG. 1, lacrosse stick 1 comprises elongated shaft 2 with lacrosse head frame and net 3 attached at one end 4. In addition to lacrosse head frame and net 3, other types of athletic equipment may be attached to shaft 2. For example, shaft 2 may be attached to a hockey blade, a tennis head frame and net, a golf club head, or no attachment in the case of a martial arts bo staff.

Shaft 2 may have any length that is appropriate for the sport and player size for which it is intended to be used. For example, for lacrosse, the shaft is preferably about 25 to about 60 inches long, for hockey it is preferably about 46 to about 62 inches long, for golf it is preferably about 20 to about 46 inches long, and for martial arts it is preferably about 30 to about 85 inches long. Shaft 2 is normally linear, but may be curved if desired.

Figure 2:
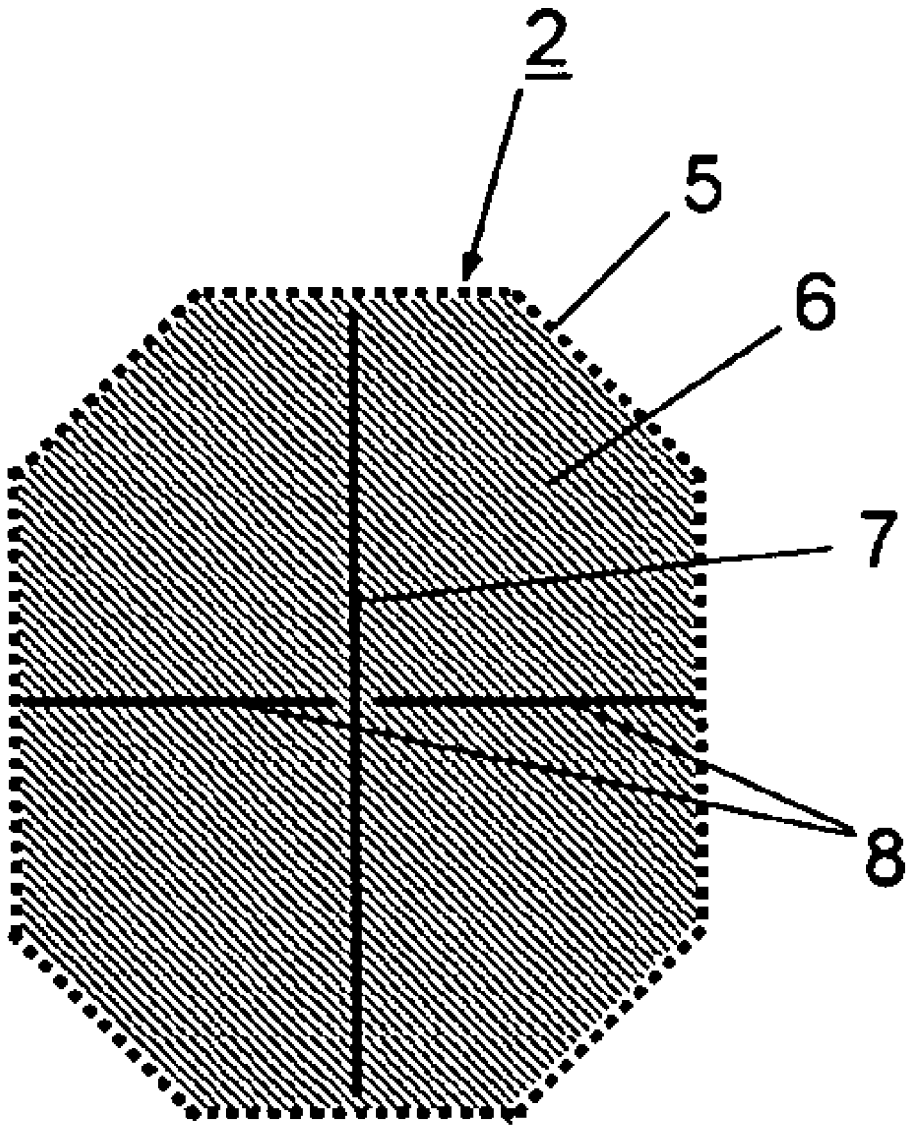
FIG. 2 is a view through A-A in FIG. 1.
Figure 3:
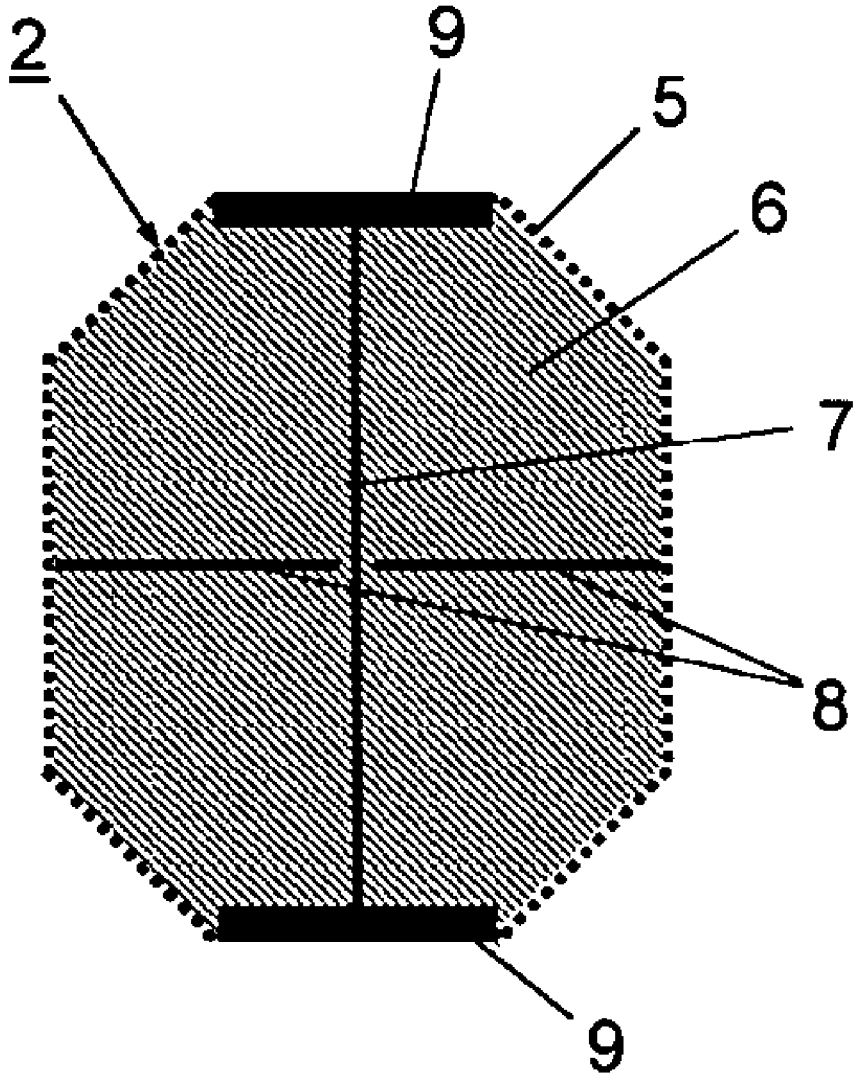
FIG. 3 is a view through B-B in FIG. 1.

In cross-section (FIGS. 2 and 3), shaft 2 may have any shape, including circular, oval, elliptical, polygonal, and other shapes, but an octagonal shape is preferred as it is usually easier for a human hand to grasp. To enable a player to feel the orientation of the shaft, the octagon preferably has four pairs of opposing parallel sides, where there are two long opposing sides, two medium length opposing sides at 90 degrees to the two long opposing sides, and four short opposing sides in between the long and medium length opposing sides at between about 30 and about 50° to the other sides, as shown in FIGS. 2 and 3. Various sports organizations may dictate the dimensions and other specifications for stick 1.

Still referring to FIGS. 2 and 3, shaft 2 has a dense and durable fiber-reinforced plastic skin 5 encasing a less dense shock-absorbing core 6. Skin 5 provides impact resistance to blows from other sticks or objects as well as rigidity to the shaft. Skin 5 is a composite material made of a hard plastic in which are embedded reinforcing fibers. Examples of suitable reinforcing fibers include fiberglass, para-aramid polymer fibers, carbon fibers, and metal fibers; a hybrid weave of polyamide (para-aramid polymer) fibers and carbon fibers is preferred because of its combined high modulus and dynamic loading capabilities. The fibers are preferably in the form of a woven fabric to provide continuous reinforcement in two directions. Preferably, the directions are perpendicular and one is aligned with the longitudinal axis of the shaft. Examples of suitable polymer resins for the fiber-reinforced composite resin skin include: polyester, vinyl ester, polycarbonate, polyamide, polyethylene, polypropylene and polyphenylene sulfide. The preferred resin is polyester because of its durability, impact strength, and UV resistance. Preferably, outer skin 5 is made of a hybrid woven fabric of carbon fiber and polyamide fiber (e.g. "Kevlar") melded in an epoxy polymer matrix resin. A coating of polyurethane or other non-slippery plastic (not shown) may be applied over skin 5 to dampen vibrations and provide a surface that is not slippery.

Core 6 is a light weight, shock-absorbing material. Examples of suitable materials include balsa wood and structural plastic foams, such as polyurethane, and polystyrene; the preferred core material is extruded polystyrene because it has a fine cell "grain" structure that runs vertically through the foam rather than horizontally or lengthwise like expanded polystyrene or polyurethane foam. The vertical cell alignment creates a rigid honeycomb effect ideal for high shear load and impact. The vertical cell structure also allows for better penetration of the epoxy resin into the foam's surface thereby enhancing the bond between the foam core 6 and the outer skin 5.

Core 6 has an elongated stiffening member(s) encased within it. In FIGS. 2 and 3 the stiffening member is spar 7, which extends the length of shaft 2, but may terminate about 0 to about 3 inches from each end. A single spar 7 may be used or several spars 7 may be used in order to increase stiffness. Spar 7 preferably has vanes 8 that extend laterally in two perpendicular directions, as shown in FIGS. 2 and 3, but may extend laterally in only a single direction or in more than two directions, or in directions that are not perpendicular, if desired. Spar 7 is preferably orientated with its vanes 8 perpendicular to sides of shaft 2. Vanes 8 are preferably about 0.015 to about 0.060 inches thick and extend from the center of spar 7 about 0.25 to about 1 inches. Spar 7 may be made of various rigid materials, such as unidirectional carbon fiber, metal, or plastic, but it is preferably made of unidirectional carbon fiber because of its superior rigidity and strength to weight ratio.

Referring to FIG. 3, shaft 2 is also provided with at least one mounting plate 9 located at end 4 to which a lacrosse head frame and net 3 or other athletic equipment may be attached. Mounting plate 9 is preferably a light-weight, high-strength material. Metals, such as aluminum alloy, steel, titanium, etc., and other materials such as mineral glass filled nylon may be used. Mounting plate 9 is preferably permanently attached to shaft 2, but it may also be attached by means of a fastener, such as clips, screws, nuts and bolts, etc., so that it may be removed and replaced if it becomes damaged or worn.

Figure 4:
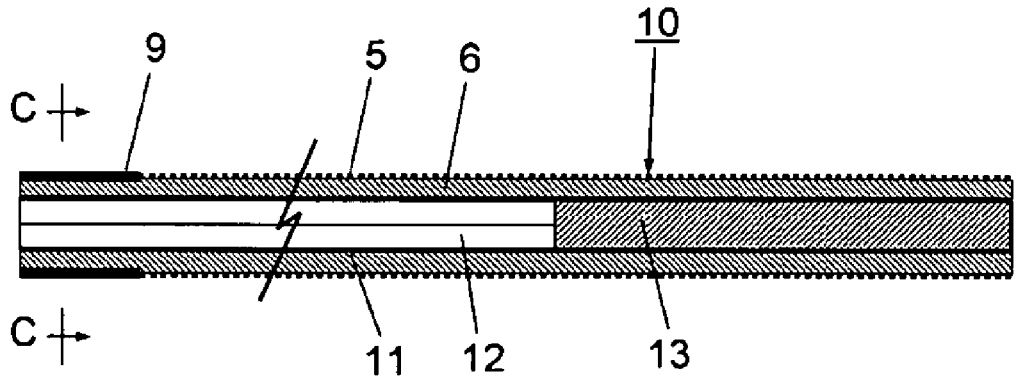
FIG. 4 is a side view in section of another certain presently preferred embodiment of a hollow tube stiffened shaft according to this invention.
Figure 5:
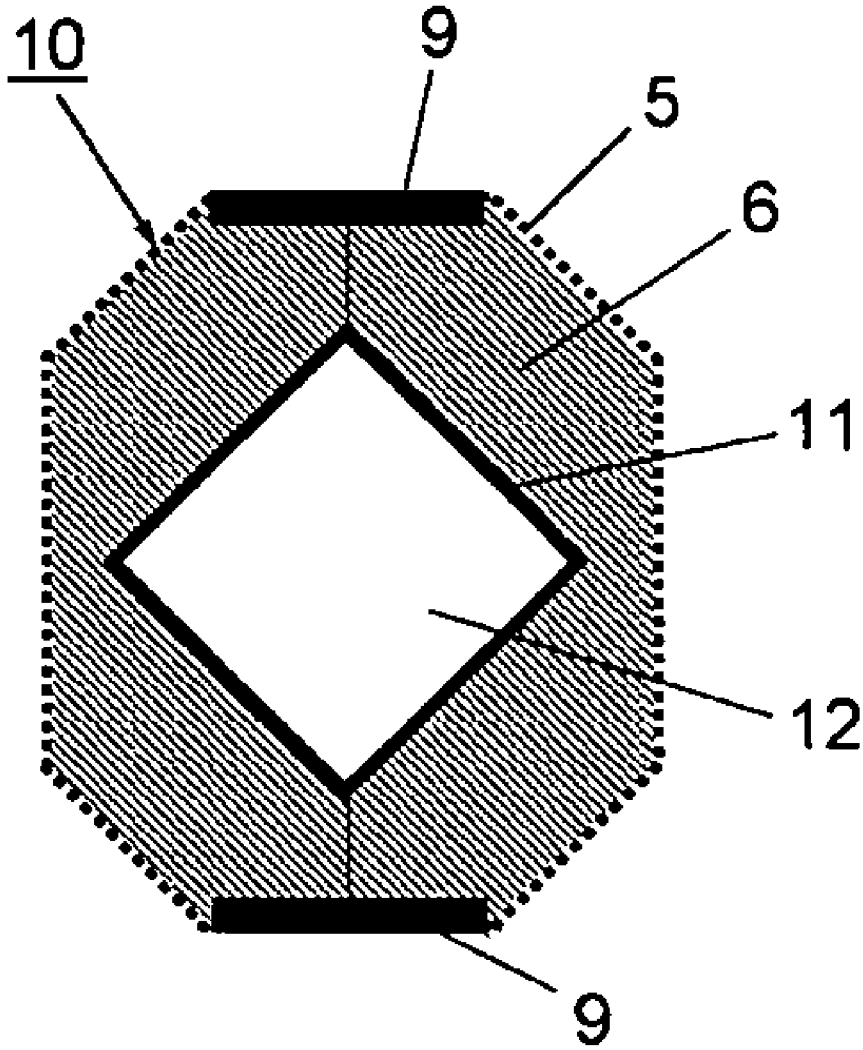
FIG. 5 is a view through C-C in FIG. 4.

In FIGS. 4 and 5, shaft 10 also has a skin 5, core 6, and mounting plate 9, but the elongated stiffening member is square hollow tube 11. Hollow tube 11 may be, in cross-section, circular, oval, elliptical, rectangular, square, or other shape; preferably, it is square or rectangular. It may be made of various rigid materials, such as metals, fiberglass, graphite, carbon fiber, or plastic, but is preferably made of carbon fiber and has walls about 0.010 to about 0.060 inches thick.

Referring to FIG. 4, the inside of hollow tube 11 is empty space 12 at one end 4 and is a light-weight, shock-absorbing counter-balance material 13, such as core 6, at the other end.

Figure 6:
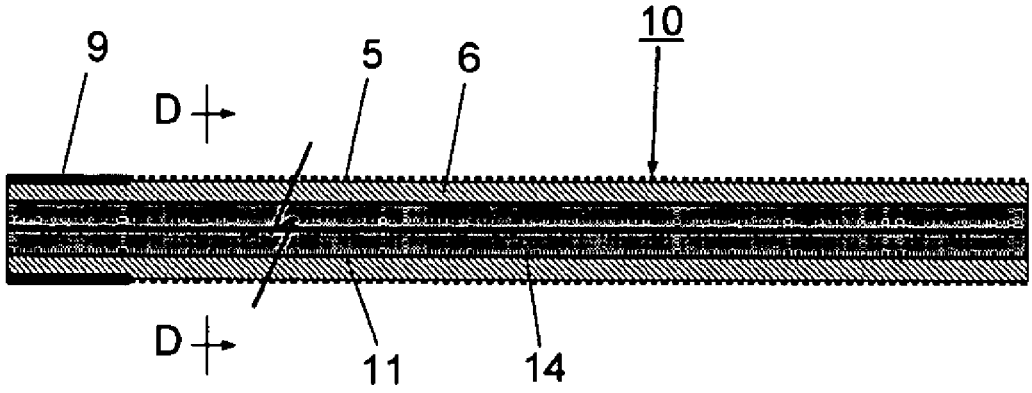
FIG. 6 is a side view in section of a shaft similar to the shaft of FIG. 4, where the hollow tube contains spars.
Figure 7:
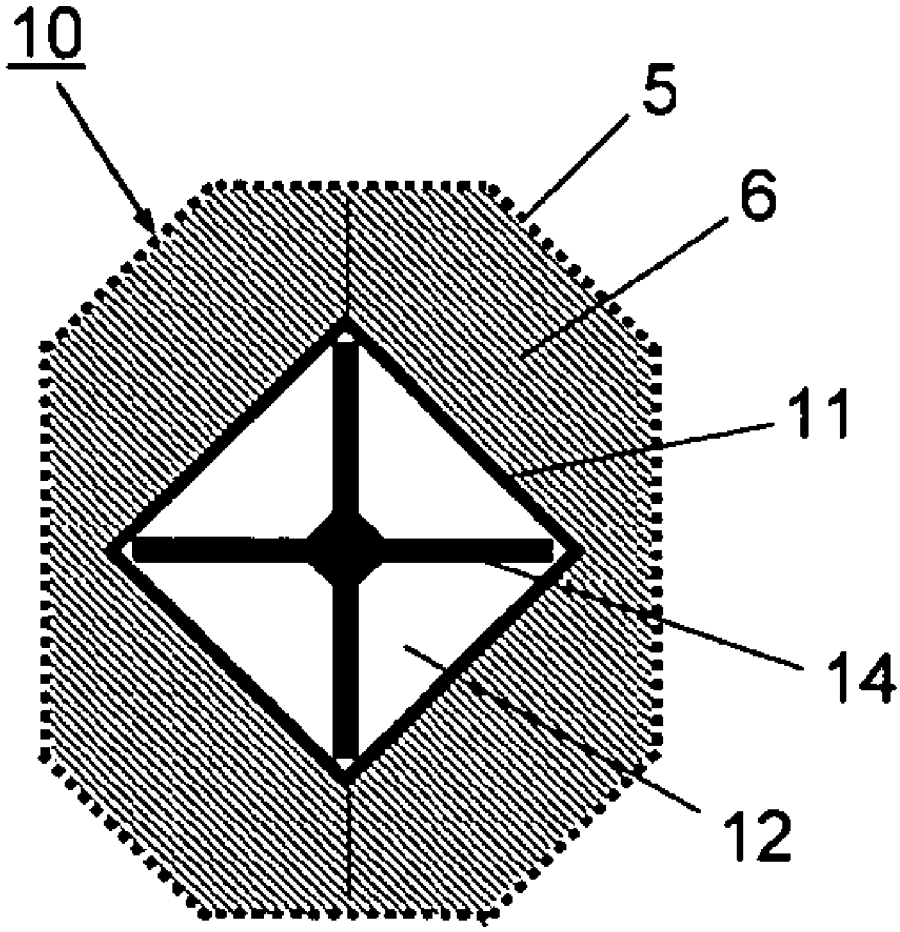
FIG. 7 is a view through D-D in FIG. 6.

In FIGS. 6 and 7, shaft 10 has a skin 5, core 6, and mounting plate 9, inside the elongated stiffening member 11 is a composite structure 14 which consist of a "X" shaped stiffener, similar to spar 7.

Figure 8:
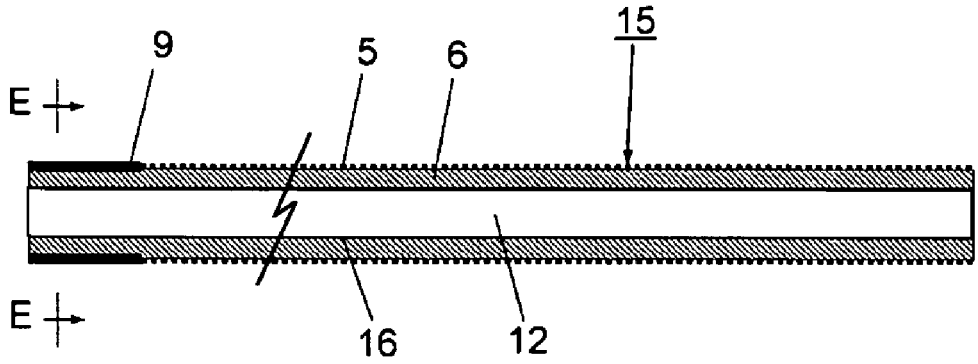
FIG. 8 is a side view in section of a shaft similar to the shaft of FIG. 4, where the internal stiffener is a round hollow tube.
Figure 9:
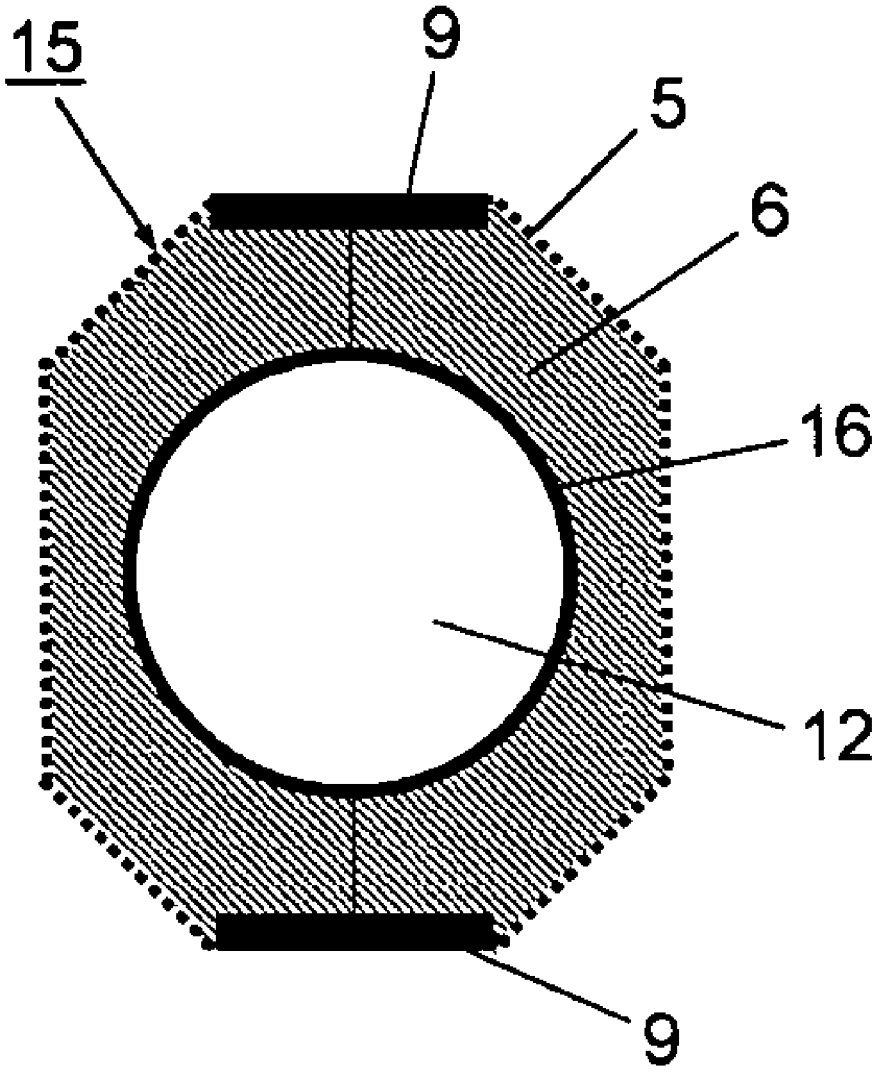
FIG. 9 is a view through E-E in FIG. 8.

In FIGS. 8 and 9, shaft 15 has a skin 5, core 6 and mounting plate 9, but the elongated stiffening member is a round hollow tube 16.

Figure 10:
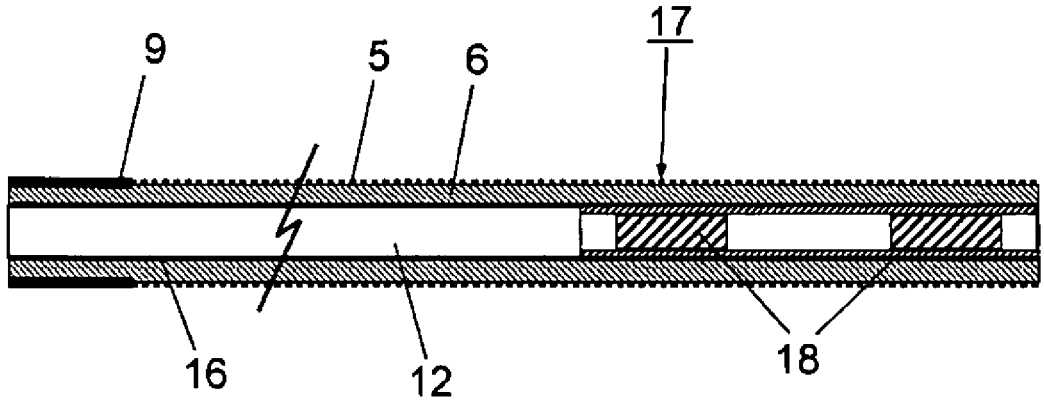
FIG. 10 is a side view in section of a shaft similar to the shaft of FIG. 8, where the hollow tube contains adjustable weights. The inside portion of tube that the weights are in contact with, is threaded, so that the user can turn the weights moving them in or out to adjust and set their fixed position. The end of the threaded weights are slotted or otherwise altered on the outside so that it can be turned by the user.

In FIG. 10, shaft 17 has a skin 5, core 6, mounting plate 9, and elongated stiffening member 16, contained within elongated stiffening member 16 are adjustable, threaded, counter-balance weights 18.

Figure 11:
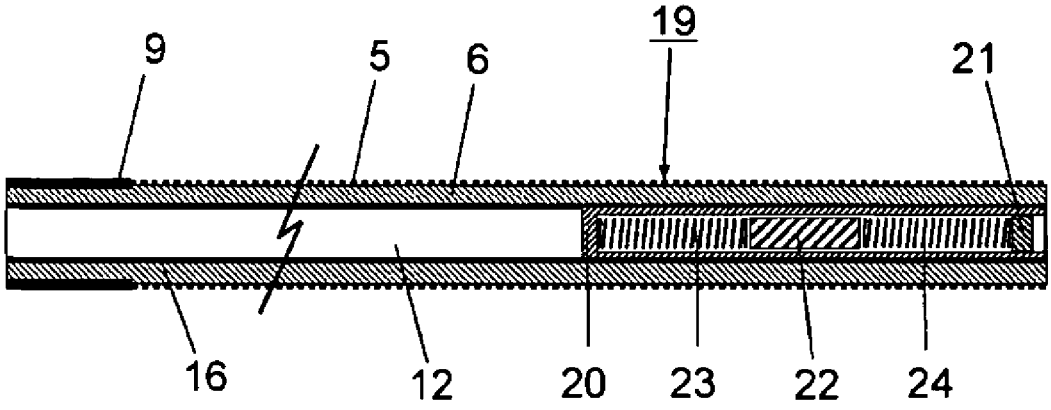
FIG. 11 is a side view in section of shaft similar to the shaft of FIG. 10, where the movement of the weight is opposed by springs.

Shaft 19, shown in FIG. 11, is similar to the shaft 17 of FIG. 10, but hollow tube 16 has a seal 20 at one end and a plug 21 at the other that is slotted on the outside (not shown). Inside tube 16 is weight 22 that slides within tube 16. A first spring 23 is in between weight 22 and seal 20 and a second spring 24 is in between weight 22 and plug 21. When shaft 19 is swung by the user, centrifugal force moves weight 22 opposite to end 4. When the swing is over, weight 22 returns its original rest position. Plug 21 is slotted or otherwise altered on the outside so that it can be turned by the user. The inside portion of tube 16 that plug 21 is in contact with is threaded so that the user can turn plug 21 to move it in or out and thereby increase or decrease the force of springs 23 and 24 on weight 22.

Figure 12:
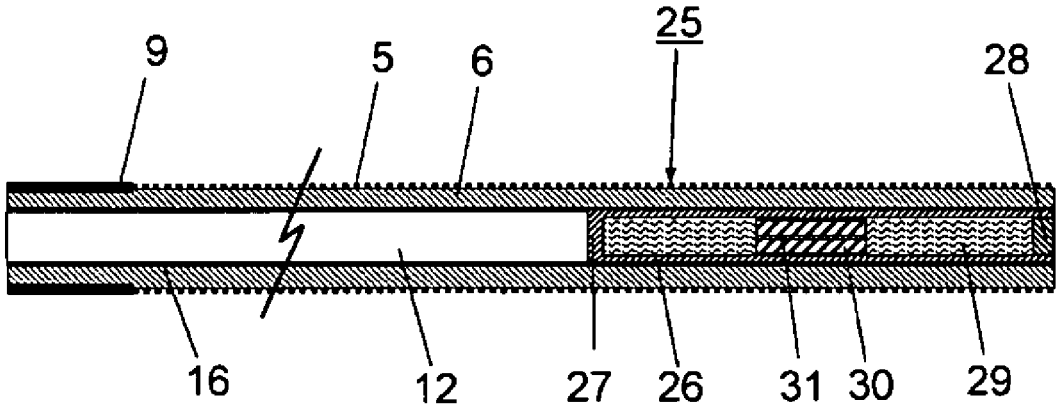
FIG. 12 is a side view in section of a shaft similar to the shaft of FIG. 10, where the movement of a weight in the hollow tube is dampened.

In FIG. 12, shaft 25 is similar to shaft 17, but has an internal hollow tube 26 (inside tube 16) with a seal 27 at one end and a plug 28 at the other. Tube 26 is filled with fluid 29 and contains weight 30 that has a passageway 31 through it. When the shaft is swung, centrifugal force moves weight 30, but fluid 29 dampens the movement. Fluid 29 is preferably a medium-viscosity, temperature-stable hydraulic dampening fluid such as motor oil, or vegetable oil. It counter balances the head and allows the player to angle the stick intentionally shifting the center of gravity providing a dynamic weighting.

Figure 13:
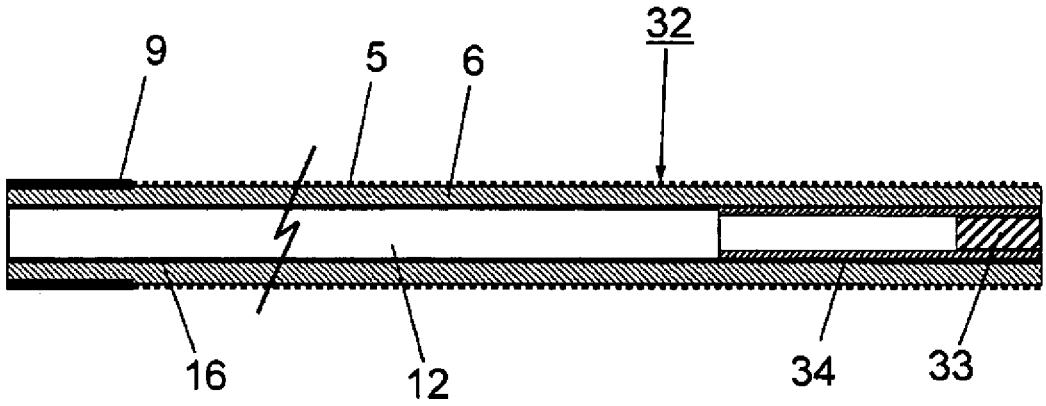
FIG. 13 is a side view of a shaft similar to the shaft of FIG. 10, where the position of the weight in the hollow tube is adjustable.

Shaft 32, in FIG. 13, is similar to shaft 17, but weight 33 has threads that engage the threaded inside of tube 34. Weight 33 is provided with, for example, a slot at the end (not shown) so that the user can adjust the position of the weight 33 along the inside of shaft 32 as well as removing or replacing the weight with a heavier or lighter weight, by turning weight 33 with a screwdriver.

Figure 14:
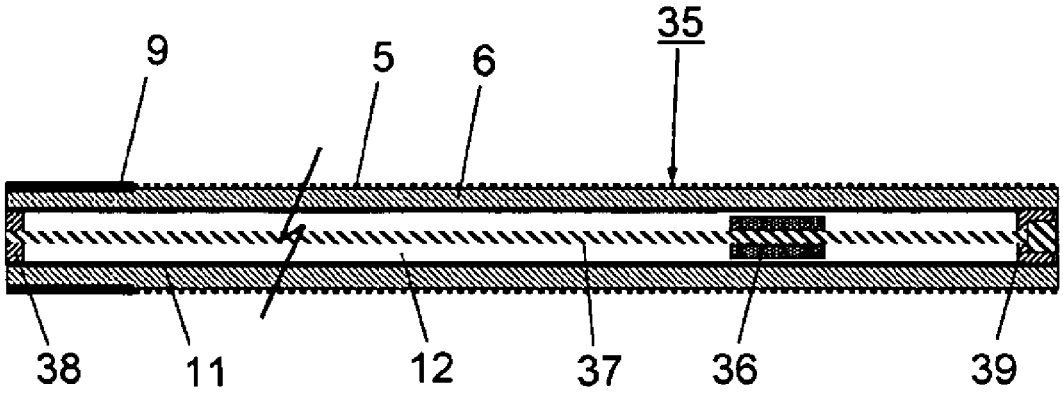
FIG. 14 is a side view of a shaft similar to the shaft of FIG. 10, where the weight is on a screw drive and its position is adjustable.

Shaft 35, in FIG. 14, is similar to shaft 9, with a skin 5, core 6, mounting plate 9, and an internal hollow tube 11. Inside tube 11 is weight 36, which threadedly engages screw drive 37. Screw drive 37 is rotatably attached to block 38 at one end and to housing 39 at the other. Screw drive 37 is provided with, for example, a slot (not shown) at the end held by housing 39 so that the user can turn it with a screwdriver, thereby moving weight 36 along the inside of tube 11.

The shafts of this invention may be made by a variety of processes that will be apparent to those skilled in the art. In one process, a foamed core stock is made by injection molding in two longitudinal halves that are partially hollowed out. The various internal parts are then inserted into one of the halves, the two halves are glued together, and the skin is applied over them. Before the skin is applied, internal spaces can be injected with foamed plastic.

EXAMPLES

Part I

Shafts of This Invention

The shafts tested in the examples had a cross-section and size similar to the commercial hollow tube designs, that is, they had a slightly elongated octagon geometry. The shaft design combined a thin outer composite skin (hybrid fabric melded in a polymer matrix resin) over a shock absorbing core with a laminated inner stiffening element. Both the skin and core elements were combined in various configurations to produce specific mechanical behavior profiles.

Three multi-layered skin configurations were tested to determine the contributions of the skin and core to performance. The first multi-layer composite skin had an inner layer of Kevlar (a para-aramid polymer fiber, long-chain synthetic polyamide sold by Dupont)/carbon hybrid fabric and an outer layer of Kevlar/carbon hybrid fabric. The second had an inner layer of Kevlar/carbon hybrid fabric and an outer layer of carbon/carbon fabric. The third had an inner layer of carbon/carbon fabric and an outer layer of carbon/carbon fabric.

Ten different material combinations were tested to determine how the shaft bending flexibility and breaking point could be altered and controlled. All ten specimens were 31 inches in length. There were four complex shaft cores without the outer skin, four complex shaft cores with Kevlar/carbon-Kevlar/carbon composite skins, and two with simple balsa cores (one with a Kevlar/carbon-carbon/carbon composite skin and the other with a carbon/carbon-carbon/carbon composite skin). Table 1 describes the test specimens.

TABLE 1

| Specimen | Weight (oz) | Type of core | Skin |
|---|---|---|---|
| A1 | 4.4 | 0.060 inch spar in balsa | None |
| A2 | 2.7 | 0.030 inch spar in balsa | None |
| A3 | 2.6 | Round graphite tube in balsa | None |
| A4 | 3.4 | Square aluminum tube in balsa | None |
| A5 | 7.2 | 0.060 inch spar in balsa | Kevlar/carbon-Kevlar/carbon |
| A6 | 6.0 | 0.030 inch spar in balsa | Kevlar/carbon-Kevlar/carbon |
| A7 | 6.1 | Round graphite tube in balsa | Kevlar/carbon-Kevlar/carbon |
| A8 | 6.1 | Square aluminum tube in balsa | Kevlar/carbon-Kevlar/carbon |
| A9 | 4.1 | Balsa core no stiffener | Kevlar/carbon-carbon/carbon |
| A10 | 4.4 | Balsa core no stiffener | Carbon/carbon-carbon/carbon |

The spar configurations (A1, A2, A5, and A6) had unidirectional carbon fiber spar stiffeners running the length of the shaft. In cross-section, the carbon-carbon spar appears as an "X" that is 0.06 or 0.03 inches thick; it was oriented so as to bisect the balsa across both minor axes of the shaft. The round graphite tubes (A3 and A7) had an outside diameter of 0.5 inches with a wall thickness of 1/16 inch; the tube ran the length of the balsa core centered on the major and minor axes of the shaft. The square aluminum tubes (A4 and A8) were square tubes with an outside length on a side of 3/8 in and a wall thickness of 1/32 inches; the tube ran the length of the balsa core centered on the major and minor axes of the shaft. The orientation of the tube was aligned with the tube corners in line with the major and minor axes of the shaft. The balsa cores (A9 and A10) were solid pieces of balsa that ran the length of the stick. The Kevlar/carbon-carbon/carbon skin and the carbon/carbon-carbon/carbon skin had a thickness of approximately 0.030 inches.

Example 1

Bending Tests

Bending load testing determined the stress-to-strain measurement under bending and the failure stress, the point of permanent deformation. Additional force was then applied to produce catastrophic failure, or collapse. Measurements were made using a Strike Bender Test Method (SBTM) Machine. This test also measured the elastic stress-strain rate of the shaft that would result from in a Lacrosse ball throwing (shooting) maneuver.

Using the SBTM, bending stress-strain was determined by mounting a shaft in the hard point bending mounts on a SBTM machine and applying a force perpendicular to the head mounting end. The shafts were mounted to bend across the shorter of the two axes. Force and deflection were measured continuously with incremental increases in the force to establish the stress-strain response until permanent deformation was observed. Upon observing permanent deformation, force was applied to produce catastrophic failure. The results are shown in Table 2, where "( )" indicates plastic deformation (elastic limit), "[ ]" indicates structural failure, "{ }" indicates collapse, and an underline indicates spalling.

The balsa core alone and skin alone individually had strengths so low they were not measurable using the SBTM machine and therefore they are not included in the test results. The core by itself had a measurable strength, but in the skin and core combination, the strength can be 2 to 5 times greater than the core alone.

TABLE 2

| | | Bending Test—Shafts of this Invention | | | | | | | | | |
|---|---|---|---|---|---|---|---|---|---|---|---|
| | | A5 | A1 | A6 | A2 | A7 | A3 | A8 | A4 | A9 | A10 |
| cm | in | | | | | | lbs | | | | |
| 1 | 0.4 | 4 | | 2 | 1 | 4 | 2 | 0 | 1 | 1 | 2 |
| 2 | 0.8 | 9 | 7 | 4 | 0 | 9 | 4 | 4 | 2 | 4 | 5 |
| 3 | 1.2 | 14 | 11 | 8 | 2 | 14 | 7 | 6 | 4 | 5 | 7 |
| 4 | 1.6 | 19 | 15 | 11 | 0 | 17 | 8 | 6 | 6 | 7 | 9 |
| 5 | 2.0 | 24 | 18 | 13 | 0 | 23 | 11 | 11 | 6 | 9 | 11 |
| 6 | 2.4 | 28 | (19) | 13 | 0 | 27 | 16 | 13 | 8 | 11 | 12 |
| 7 | 2.8 | 33 | 20 | 15 | [7] | 31 | 17 | 15 | 9 | 12 | 14 |
| 8 | 3.1 | 38 | 22 | 25 | | 35 | 20 | 17 | 10 | 14 | 16 |

TABLE 2-continued

Bending Test—Shafts of this Invention

| cm | in | A5 | A1 | A6 | A2 | A7 | A3 lbs | A8 | A4 | A9 | A10 |
|---|---|---|---|---|---|---|---|---|---|---|---|
| 9 | 3.5 | 43 | 24 | 28 | 0 | 38 | 23 | 19 | 11 | 14 | 17 |
| 10 | 3.9 | (45) | 27 | 31 | 0 | 41 | 25 | 20 | 12 | 16 | [20] |
| 11 | 4.3 | 51 | 28 | 31 | | 44 | [26] | (22) | [10] | 17 | 21 |
| 12 | 4.7 | 55 | 29 | 34 | | 48 | {26} | 22 | 11 | 19 | 22 |
| 13 | 5.1 | 60 | {30} | 36 | | [50] | | 24 | 11 | 20 | 22 |
| 14 | 5.5 | 66 | | 39 | | {58} | | 24 | 11 | [19] | 24 |
| 15 | 5.9 | 70 | | [32] | {13} | | | 26 | {11} | 20 | 24 |
| 16 | 6.3 | 77 | | 34 | | | | 26 | | | 26 |
| 17 | 6.7 | [81] | | 35 | | | | 28 | | 21 | 26 |
| 18 | 7.1 | 86 | | {35} | | | | [28] | | 22 | 26 |
| 19 | 7.5 | 53 | | | | | | | | 21 | 26 |
| 20 | 7.9 | 62 | | | | | | | | 21 | 26 |
| 21 | 8.3 | {65} | | | | | | 27 | | 21 | 26 |
| 22 | 8.7 | | | | | | | {27} | | 21 | 27 |
| 23 | 9.1 | | | | | | | | | {21} | 26 |
| 24 | 9.4 | | | | | | | | | | {26} |
| 25 | 9.8 | | | | | | | | | | |

The stronger shaft in A5 exhibited no plastic deformation until it had been bent through 3.9 in at 45 lb of force. In A8, the square aluminum core stiffener had plastic deformation at 13 lb force and 2.4 in deflection. Thus, the point of plastic deformation ranged from 2.4 inches to 3.9, a factor of 1.6.

Example 2

Stress-Strain

Using the data given in Table 2, the stress-strain, the stress at plastic deformation, and the elastic linear stress-strain rate were calculated. Table 3 gives the results.

TABLE 3

Test Elastic Stress and Strain

| Specimen | Core - skin | Stress (lbs) | Strain (in) | Elastic Stress/Strain Rate (lbs/in) |
|---|---|---|---|---|
| A1 | 0.060 inch spar in balsa - no skin | 18 | 2.0 | 9 |
| A2 | 0.030 inch spar in balsa - no skin | 7.1 | 2.8 | 2.5 |
| A3 | Round graphite tube in balsa - no skin | 16 | 2.4 | 6.7 |
| A4 | Square aluminum tube in balsa - no skin | 6 | 2.0 | 3 |
| A5 | 0.060 inch spar in balsa - Kevlar/carbon-Kevlar/carbon | 33 | 2.8 | 11.8 |
| A6 | 0.030 inch spar in balsa - Kevlar/carbon-Kevlar/carbon | 31 | 5.1 | 6.1 |
| A7 | Round graphite tube in balsa - Kevlar/carbon-Kevlar/carbon | 38 | 3.5 | 11 |
| A8 | Square aluminum tube in balsa - Kevlar/carbon-Kevlar/carbon | 17 | 3.1 | 5.5 |
| A9 | Balsa - Kevlar/carbon-carbon/carbon | 14 | 3.5 | 4 |
| A10 | Balsa - carbon/carbon-carbon/carbon | 12 | 2.4 | 5 |

The various cores with skin had a significant increase in bending strength over cores without skin. Adding a core stiffening element (A8) to the simple balsa core (A9) increased the bending stress-strain rate from 4 to 5.5, a factor of 1.37 and, by selecting a more efficient core stiffening element, the factor was increased to 3 (A5 compared to A9 is 11.8/4=2.95). By changing the core stiffeners, as was done A5, A6, A7, and A8, the bending stress-strain rates varied by a factor of 2, (11.8/5.5=2.1).

In the weakest of the sticks of this invention, A8, the square aluminum core stiffener had a plastic deformation at 22 lb force and 4.3 in deflection. The remainder of the shafts of this invention exhibited no plastic deformation up to structural failure. Thus, the point of plastic deformation and the structural failure point can be engineered by altering the core stiffener component.

In the case of the two balsa cores without the core stiffening elements (A9 and A10) there was a (5/4=1.25) a 25% difference in the bending stress-strain rate between the same core and two different skins. However, the balsa-carbon/carbon-carbon/carbon composite shaft (A10) weighed 0.3 oz more than the balsa-Kevlar/carbon-carbon/carbon shaft (A9). Subtracting the weight of the balsa (1 oz) from each of the shaft weights and taking the ratio of the skin weights, the carbon/carbon-carbon/carbon skin (A10) was 3.4/3.1=1.097 or 9.7% heavier. If the balsa core in each test is providing the same stiffness, then adjusting the total shaft stress-strain rate ratio to have the same skin weights, i.e. 1.25 times 3.1/3.4=1.14, the shaft with the carbon/carbon-carbon/carbon skin (A10) was 14% stronger than the Kevlar/carbon-carbon/carbon skin (A9).

TABLE 4

Skin minus no skin

| Specimens | Core | Skin/no skin elastic stress-strain rate | Skin minus no skin elastic stress-strain rate (lb/in) |
|---|---|---|---|
| A5/A1 | 0.060 inch spar in balsa | 11.8/9 = 1.3 | 11.8 − 9 = 2.8 lb/in |
| A6/A2 | 0.030 inch spar in balsa | 6.1/2.5 = 2.4 | 6.1 − 2.4 = 3.7 |
| A7/A3 | Round graphite tube in balsa | 11/6.7 = 1.7 | 11 − 6.7 = 4.3 |
| A8/A4 | Square aluminum tube in balsa | 5.5/3 = 1.8 | 5.5 − 3 = 2.5 |
| Average | | 1.8 | 3.3 lb/in |

Adding the skin increased the stress-strain rate (stiffness) for each of the cores on average by 3.3 lb/in.

TABLE 5

Increase in bending stress-strain

| Specimens | Core | Skin Increases bending stress-strain rate by |
|---|---|---|
| A5/A1 | 0.060 spar in balsa | 11.8/9 = 1.3 |
| A6/A2 | 0.030 spar in balsa | 6.1/2.5= 2.4 |
| A7/A3 | Round graphite tube in balsa | 11/6.7 = 1.7 |
| A8/A4 | Square Aluminum tube in balsa | 5.5/3 = 1.8 |
| | Average | 1.8 |

There was a significant increase in bending strength for the cores with skin over the cores without skin. On average, adding the skin increased the bending stress-strain rate by a factor of 1.8 for the skin thickness and cores tested.

Example 3

Structure Failure

Using the data in Table 3, Table 6 gives the point of structural failure. The test specimens broke without producing sharp jagged edges at the point of failure.

TABLE 6

Structural Failure

| Specimen | Type of core-skin | Structural point failure lbs | Structural point failure in | Stress-strain ratio (lb/in) |
|---|---|---|---|---|
| A5 | 0.060 inch spar in balsa - Kevlar/carbon-Kevlar/carbon | 81 | 6.7 | 12 |
| A6 | 0.030 inch spar in balsa - Kevlar/carbon-Kevlar/carbon | 32 | 5.9 | 5.4 |
| A7 | Round graphite tube in balsa - Kevlar/carbon-Kevlar/carbon | 50 | 5.1 | 9.8 |
| A8 | Square aluminum tube in balsa - Kevlar/carbon-Kevlar/carbon | 28 | 7.1 | 3.9 |

The core stiffener design affects the amount of force needed to cause structural failure. For the shafts of this invention tested in this program, there was almost a factor of three, from 3.9 to 12 lb/in, difference in the bending stress-strain rate at structural failure.

Example 4

Impact Vibration Tests

The impact/vibration test measured the vibration retention in the stick shaft after an impact.

Vibration damping was measured on the SBTM machine. A lacrosse stick was mounted in the machine and a speed controlled striking tube impacted a mounted lacrosse stick 3 in from the "head end" and 15 in from the nearest of two mount points. For the vibration test the standard impact was provided by adjusting the striker bar end velocity to 30 miles/hour. This simulated the stick velocity achieved when a lacrosse ball is passed from one player to another during play. The mounting of the test fixture is the same for each stick and was achieved by a non-adjustable latching mount. Acoustical vibrations were measured midway between the two mounting points which were positioned 10 in apart to simulate a player's grip.

An integral of frequency and amplitude over time called the Total Power Measurement is the result of the strike energy. This is extracted from the measurement data using the Spectra Plus analyzer "total power utility." The Total Power (−dB) is used to verify that the impact on each test specimen was consistently applied so that other presentations of the recorded acoustic measurement can be directly compared.

TABLE 7

Integrated Vibration Energy

| Specimen | Type of core-skin | Total Power (dB) |
|---|---|---|
| A5 | 0.060 spar in balsa - Kevlar/carbon-Kevlar/carbon | 59.8 |
| A6 | 0.030 spar in balsa - Kevlar/carbon-Kevlar/carbon | 64.2 |
| A7 | round graphite tube in balsa - Kevlar-carbon-Kevlar/carbon | 61.1 |
| A8 | square Aluminum tube in balsa - Kevlar-carbon-Kevlar/carbon | 69 |
| A9 | Balsa core - Kevlar/carbon - carbon/carbon | 74 |
| | Average Total Power 65.6 | |

In Table 7 the similarity in total power shows the impact energy delivered to the sticks by the striker bar was comparable.

Example 5

Decay Time

Table 8 lists the decay time. That is the time from the impact sharp rise until the vibrations decay to the background noise level.

TABLE 8

Vibration Energy Decay Time

| Specimen | Type of core-skin | Decay Time (sec) |
|---|---|---|
| A5 | 0.060 spar in balsa- Kevlar/carbon-Kevlar/carbon | 0.037 |
| A6 | 0.030 spar in balsa- Kevlar/carbon-Kevlar/carbon | 0.031 |
| A7 | round graphite tube in balsa- Kevlar-carbon-Kevlar/carbon | 0.037 |
| A8 | square Aluminum tube in balsa- Kevlar/carbon-Kevlar/carbon | 0.036 |
| | Average: 0.035 | |
| A9 | Balsa core - Kevlar-carbon/carbon | 0.031 |

The shortest decay time was for A9. Because A6 had the same decay time, sec, as A9, it indicates that a spar that thin does not retain vibrational energy.

The shortest decay time with a shaft of this invention was with a balsa core and no core stiffening element (A9). The thin 0.03 spar (A6) had the same decay time, 0.031 sec, as the specimen with no core stiffening element (A9), indicating that a thin spar does not retain vibrational energy. The average decay time for the shafts of this invention that had core stiffeners was 0.035.

PART II

Comparison with Commercial Shafts

Example 6

Commercial Shafts—Bending Test

A set of commercial hollow tube shafts were selected for testing that were representative of those sold by several major sports equipment manufacturers. These shafts had a shaft cross-section that was a slightly elongated octagonal geometry. Table 9 describes the shafts.

TABLE 9

Commercial Test Specimens

| Specimen | Length (in) | Weight (oz) | Material | Manufacturer | Model |
|---|---|---|---|---|---|
| Hollow Metal Tubes | | | | | |
| C-1 | 30.5 | 8.6 | Alloy | STX | Titanium |
| C-2 | 30.5 | 7.2 | Alloy | Brine | Swizzle |
| C-3 | 30.25 | 6.5 | Alloy | Warrior | Levitathon |
| C-4 | 31 | 5.6 | Alloy | STX | SC + TI |
| C-5 | 31 | 5.3 | Alloy | STX | Scandium |
| C-6 | 31 | 5.8 | Alloy | STX | C405 |
| C-7 | 30 | 6.1 | Alloy | Warrior | Kryptolyte |
| C-8 | 31 | 6.1 | Alloy | STX | Steel 7000 |
| C-9 | 30.5 | 5.7 | Alloy | Brine | Supra 7075 |
| C-10 | 31 | 6.2 | Alloy | Warrior | Alloy 2000 |
| Split Shaft (Hybrid) | | | | | |
| C-11 | 30 | 7.1 | Alloy-composite | Warrior | Split shaft |
| Composite Hollow Tube | | | | | |
| C-12 | 30 | 7.1 | Composite | Brine | Python |
| C-13 | 30.25 | 5.7 | Composite | Brine | Composite |

The same tests that were performed in the preceding examples were performed on the commercial hollow alloy tube shafts. The results are given in Table 10.

TABLE 10

Bending Test—Hollow Tube Commercial Shafts

| cm | in | C1 | C5 | C2 | C6 | C3 | C7 | C4 | C8 | C9 | C10 |
|---|---|---|---|---|---|---|---|---|---|---|---|
| | | | | | | lbs | | | | | |
| 1 | 0.4 | 10 | 7 | 10 | 9 | 5 | 5 | 8 | 7 | 7 | 4 |
| 2 | 0.8 | 22 | 16 | 18 | 16 | 13 | 16 | 17 | 15 | 15 | 8 |
| 3 | 1.2 | (35) | 26 | 27 | 26 | 21 | 25 | 26 | 25 | 23 | 18 |
| 4 | 1.6 | 46 | 36 | (36) | 36 | | 35 | 35 | (36) | (33) | 30 |
| 5 | 2.0 | 60 | (46) | 45 | 46 | | 44 | (50) | 42 | [41] | (39) |
| 6 | 2.4 | 71 | 57 | 56 | 55 | | 49 | 62 | 50 | 44 | 51 |
| 7 | 2.8 | 82 | 66 | 61 | 64 | 29 | 60 | 70 | [58] | 47 | [61] |
| 8 | 3.1 | 94 | 72 | 68 | 76 | 64 | 68 | 81 | 62 | 50 | 60 |
| 9 | 3.5 | 105 | 78 | 79 | (84) | (70) | (79) | [94] | {62} | 49 | 62 |
| 10 | 3.9 | 114 | 83 | 83 | 90 | [78] | 86 | 99 | | 48 | {58} |
| 11 | 4.3 | 127 | [93] | 89 | [98] | {81} | [94] | 100 | | 48 | 60 |
| 12 | 4.7 | 140 | 97 | 96 | 100 | 77 | 95 | 98 | | {49} | 60 |
| 13 | 5.1 | [151] | 99 | [100] | {100} | 76 | {100} | {103} | | 47 | |
| 14 | 5.5 | 154 | 102 | 107 | 72 | 51 | 99 | 98 | | 43 | |
| 15 | 5.9 | 154 | {110} | 111 | 63 | 36 | 99 | | | 40 | |
| 16 | 6.3 | 168 | 106 | {115} | 51 | 29 | 74 | 67 | | 39 | |
| 17 | 6.7 | {153} | 65 | 94 | 38 | | 64 | 60 | | | |
| 18 | 7.1 | 148 | | 79 | | | 60 | 56 | | | |
| 19 | 7.5 | 82 | | 57 | | | 55 | 54 | | | |
| 20 | 7.9 | | | 41 | | | | | | | |
| 21 | 8.3 | | | | | | | | | | |

Table 11 compares the bending test results with the results for the shafts of this invention.

TABLE 11

Bending Test—Comparison of Composite Shafts

| cm | in | C11 | C12 | C13 | A5 | A6 | A7 | A8 |
|---|---|---|---|---|---|---|---|---|
| | | | | | lbs | | | |
| 1 | 0.4 | 8 | 4 | 7 | 4 | 2 | 4 | 0 |
| 2 | 0.8 | 19 | 9 | 14 | 9 | 4 | 9 | 4 |
| 3 | 1.2 | 31 | 14 | 23 | 14 | 8 | 14 | 6 |
| 4 | 1.6 | 48 | 19 | 32 | 19 | 11 | 17 | 6 |
| 5 | 2.0 | 59 | 23 | 43 | 24 | 13 | 23 | 11 |
| 6 | 2.4 | (70) | 25 | 52 | 28 | 13 | 27 | 13 |
| 7 | 2.8 | 83 | 29 | 61 | 33 | 15 | 31 | 15 |
| 8 | 3.1 | 95 | 34 | 75 | 38 | 25 | 35 | 17 |
| 9 | 3.5 | 109 | 39 | 78 | 43 | 28 | 38 | 18 |
| 10 | 3.9 | [124] | 46 | {85} | 45 | 31 | 41 | 20 |
| 11 | 4.3 | 132 | 52 | | 51 | 31 | 44 | 22 |
| 12 | 4.7 | [138] | 57 | | 55 | 34 | 48 | (22) |
| 13 | 5.1 | | 62 | | 60 | 36 | [50] | 24 |
| 14 | 5.5 | | {68} | | 66 | 39 | {58} | 24 |
| 15 | 5.9 | | | | 70 | [32] | | 26 |
| 16 | 6.3 | | | | 77 | 34 | | 26 |
| 17 | 6.7 | | | | [81] | 35 | | 28 |
| 18 | 7.1 | | | | 86 | {35} | | [28] |
| 19 | 7.5 | | | | 53 | | | |
| 20 | 7.9 | | | | 62 | | | |
| 21 | 8.3 | | | | {65} | | | 27 |
| 22 | | | | | | | | {27} |
| 23 | | | | | | | | |

Example 7

Commercial Shafts, Stress-Strain Test

TABLE 12

Hollow Tube Test Elastic Stress/Strain Rates

| Specimen | Stress (lb) | Deformation deflection (in) | Stress/strain (lb/in) |
|---|---|---|---|
| | | Metal Alloy | |
| C-1 | 35 | 1.2 | 30 |
| C-2 | 78 | 3.5 | 22.3 |
| C-3 | 79 | 3.5 | 22.6 |
| C-4 | 64 | 2.8 | 22.9 |
| C-5 | 29 | 2.8 | 18 |
| C-6 | 49 | 2.4 | 20.4 |
| C-7 | 26 | 1.2 | 21.7 |
| C-8 | 25 | 1.2 | 20.8 |
| C-9 | 23 | 1.2 | 19.2 |
| C-10 | 30 | 1.6 | 18.8 |
| | | Split shaft hybrid | |
| C-11 | 59 | 2 | 29.5 |
| | | Composites | |
| C-12 | 34 | 3.1 | 11 |
| C-13 | 52 | 2.4 | 21.8 |

The sticks of this invention with stiffened cores and skin (A5, A6, A7, and A8) ranged in elastic stress-strain ratio over a factor of 2 from 5.5 to 11.8 lb/in (Table 3), where the hollow tube alloy set (C1 to C13) also ranged almost a factor of 2 from a low of 18 to a high of 30 lb/in. Comparing the heaviest of the hollow metal tubes (C1) to the lightest of the test specimens (C5), the ratio of elastic stress-strains ratios 30/18=1.7 is comparable to the ratio of shaft weights 8.6/5.3=1.6. Since the lengths and cross-sections are the same, the resistance to bending varied directly with the wall thickness. The lowest of the alloy tubes had an elastic stress-strain ratio 18/11.8=1.53, which was 53% stiffer than the highest of the shafts of this invention, indicating that the shafts of this invention were about half as stiff as the hollow alloy tube products.

The shafts of this invention exhibited no plastic deformation up to structural failure except for the core with a square aluminum core stiffening element (A8). The square aluminum core stiffener had plastic deformation at 22 lb force and 4.3 inch deflection. Thus, the point of plastic deformation and the structural failure point can be engineered by altering the core stiffener component. The stiffest shaft (A5) had a deformation of 6.7 inches and an 80 lb stress at the point of structural failure.

The point of plastic deformation depended upon the shaft thickness and the properties of the alloy used. The hollow alloy tube shaft with the highest stiffness (C1) had a 30 lb/in stress-strain rate and exhibited permanent deformation at a stress of 35 lbs and a deflection of 1.2 in. The three lightest specimens (C4, C5, and C6) had plastic on-set at a deflection of 3.5 in and stress of about 80 lb, showing they were more flexible. The remaining 70% of the alloy shafts exhibited plastic set with deflections under 2.0 in.

All hollow metal shafts failed plastically, taking a permanent set (bend) by 3.5 in. deflection. The shafts of this invention had about twice the flexibility of the hollow alloy tube shafts.

The split shaft hybrid (C8) responded to the bending force applied in the test very much like the strongest of the hollow alloy tubes (C1). The stress-strain ratio at structural failure was 32 lb/in for the split shaft hybrid compared to 30 lb/in for the hollow alloy tube.

For the two non-metallic tube designs (C9 and C10) that weighed 7.1 oz and 5.7 oz, respectively, the elastic stress-strain ratios were 11 and 21.8 lb/in. Here, the ratio of the elastic stress-strain ratios was 11/21.8 lb/in=0.5 and the ratio of weights was 7.1/5.7=1.25, indicating that the stiffness of the composite designs did not vary as it did for the metallic tubes, where the stiffness varied directly with the weight, but rather it is a result of the design of the tube.

Example 8

Commercial Shafts, Stress-Strain at Failure

TABLE 13

Hollow Tube Test Stress-Strain at Failure

| | Plastic Deformation | | Structural failure | | |
|---|---|---|---|---|---|
| Specimen | Stress (lb) | Deformation (in) | Stress (lb) | Deflection (lb) | Ratio |
| | | Metal Alloy | | | |
| C-1 | 35 | 1.2 | 151 | 5.1 | 30 |
| C-2 | 46 | 2.0 | 93 | 4.3 | 22 |
| C-3 | 36 | 1.6 | 100 | 5.1 | 20 |
| C-4 | 84 | 3.5 | 98 | 4.3 | 23 |
| C-S | 70 | 3.5 | 78 | 3.9 | 20 |
| C-6 | 79 | 3.5 | 94 | 4.3 | 22 |
| C-7 | 50 | 2.0 | 94 | 3.5 | 27 |
| C-8 | 36 | 1.6 | 58 | 2.8 | 21 |
| C-9 | 33 | 1.6 | 50 | 3.1 | 16 |
| C-10 | 39 | 2.0 | 61 | 2.8 | 22 |
| | | Split shaft hybrid | | | |
| C-11 | 70 | 2.4 | 124 | 3.9 | 32 |
| | | Composites | | | |
| C-12 | 62 | 5.1 | 68 | 5.5 | 12.4 |
| C-13 | 78 | 3.5 | 85 | 3.9 | 22 |

The lowest structural failure stress-strain ratio was 16 and the highest 30. The average was 22.3.

Hollow metal tubes, when bent to folding, present sharp points at each side of the fold and, in the case of strong alloys, metal spall. In one case, a 3/16 by ½ inch long piece was forcefully ejected from the surface (C4).

The stress-strain ratios at structural failure were slightly higher than elastic for both C9 and C10.

The stiffer cores of the shafts of this invention affected the amount of force needed to cause structural failure. There was almost a factor of three from 3.9 to 12 lb/in in the bending stress-strain rate at structural failure for cores of different stiffness. The elastic strain varied from 5.1 to 6.7 in of deflection (strain) for the stronger cores. The lowest structural failure stress-strain ratio for the hollow alloy tube was 16 and the highest 30 lb/in. The average was 22.3 lb/in, compared to 12 for the stiffest shaft of this invention. Thus, the shafts of this invention were about half as stiff as the hollow alloy tubes at failure by intent.

Hollow metal tubes when bent to folding present sharp points at each side of the fold and, in the case of strong alloys, metal spall. In one case a pieces $3/16^{th}$ of an inch by ½ inch long was forcefully ejected from the surface of Specimen C1. The test shafts of this invention broke without producing sharp jagged edges at any point of failure.

The lowest structural failure stress-strain ratio for the hollow alloy tubes was 16 lb/in and the highest was 30 lb/in. The average was 22.3 lb/in compared 12 for the stiffest shaft of this invention.

In all respects, the split shaft hybrid design was a subset of the hollow alloy tubes and performed similarly to the stiffest of the hollow alloy tube specimens.

The two hollow tube composites specimens were split in their performance. C8, the stiffest (elastic stress-strain ratio of 22 lb/in), performed at about the average of the hollow alloy tube shafts. C9, the less stiff hollow composite tube shaft, had the same elastic stress-strain ratio as the stiffest of the shafts of this invention, but it failed and broke at a deflection of 5.5 inches whereas the shafts of this invention flexed to 8.3 inches deformation before breaking and flexed (8.3/5.5=1.51) 51% farther than the comparable hollow tube composite design, a significant safety advantage.

Example 9

Frequency Range

Table 14 shows the frequency range from the impact test for the shafts of this invention.

TABLE 14

Vibration Frequency content

| Specimen | Type of core-skin | Frequency Range (kHz) |
|---|---|---|
| A5 | 0.060 spar in balsa - Kevlar/carbon-Kevlar/carbon | 0 to 2 |
| A6 | 0.030 spar in balsa - Kevlar/carbon-Kevlar/carbon | 0 to 2 |
| A7 | Round graphite tube in balsa - Kevlar-carbon-Kevlar/carbon | 0 to 1.5 |
| A8 | Square Aluminum tube in balsa - Kevlar/carbon-Kevlar/carbon | 0 to 1 |
| A9 | Balsa core - Kevlar/carbon-carbon/carbon | 0 to 2 |

Most of the impact-vibration energy in the shafts of this invention was concentrated in the lower frequencies (0 to 0.5 kHz) with little frequency content above 2 kHz and will transmit less shock than other shaft technologies to the hands of a player in a stick on stick impact. Lower frequency vibrations are felt more like a push than a hit in a stick on stick impact. All the hollow tube alloy specimens have a split in their frequency content with large fractions of their vibration energy concentrated in the 0 to 1 kHz and 4 to 5 kHz frequencies. The hollow composite designs have vibration energy concentrated in the lower frequencies (0 to 2 kHz) with little frequency content above 3 kHz. The frequency content in the composite hybrid was the same as the alloy hollow tube shafts, i.e., the energy was concentrated in the 0 to 1 kHz range and also at 4 to 5 kHz.

Example 10

Commercial Shafts. Decay Time & Frequency Range

To show the vibration test impact is consistently applied, the "Integrated Vibration Energy" called here the total power is listed in Table 15. The decay time is the time from the sharp rise to the background noise level.

TABLE 15

Hollow Tube Vibration Test

| Specimen 1 | Total Power (-db) | Decay Time (sec) | Frequency Range (KHz) | Frequency concentration Range (KHz) |
|---|---|---|---|---|
| | | Alloy Hollow Tube | | |
| C1 | 64.2 | 0.066 | 0 to 5 | 0 to 1 4 to 5 |
| C6 | 62.7 | 0.05 | 0 to 5 | 0 to 1 4 to 5 |
| C9 | 69.3 | 0.044 | 0 to 6 | 0 to 1 4 to 5 |
| Average | 65.4 | 0.053 | | |
| | | Hollow Composite Tube | | |
| C12 | 62.7 | 0.035 | 0 to 3 | 0 to 2 |
| C13 | 73.9 | 0.040 | 0 to 3 | 0 to 2 |
| Average | 68.3 | 0.0375 | | |
| | | Split Shaft Hybrid | | |
| C11 | 65.7 | 0.043 | 0 to 5 | 0 to 1 4 to 5 |

In Table 15 the similarity in total power shows the impact energy delivered to the sticks by the striker bar was comparable.

The decay time was 50% and 30% longer in the stronger hollow tube alloy design, C1 verses C6 and C9 that had the lower linear stress-strain rates (30 lb/inch for C1 and 20.4 for C6 and 19.2 for C9).

Comparing averages from decay ranges that do not overlap, the alloy hollow tube shafts retained vibrational energy 0.053 sec/0.035 sec=1.51 or 51% longer than the shafts of this invention.

Comparing averages from decay ranges, the hollow composite tube shafts retained vibrational energy 0.0375 sec/0.035 sec=1.071 or 7.1% longer than the shafts of this invention.

Comparing the average of the decay range to the hybrid decay time, the hollow composite tube shaft retained vibrational energy 0.043 sec/0.035 sec=1.23 or 23% longer than the shafts of this invention.

The average decay time for the shafts of this invention with core stiffeners was 0.035 sec. The decay times for the alloy hollow tube selected specimens ranged from 0.044 to 0.066 sec with an average of 0.053 sec.

What is claimed is:

1. A lacrosse shaft comprising:

a first end and a second end;

an outer skin component, extending from the first end to the second end, the outer skin component comprising a fabric comprising a weave of carbon fibers, the fibers extending in at least two directions;

a shock-absorbing component, extending from the first end to the second end, the shock-absorbing component comprising a core foam, wherein the outer skin component encases the shock-absorbing component and is coupled to the shock-absorbing component using an epoxy resin, and the shock-absorbing component has an outer surface and an inner surface, the outer surface being octagonal and the inner surface being circular; and an elongated stiffening component, extending from the first end to the second end, the elongated stiffening component comprising unidirectional carbon fiber, wherein the elongated stiffening component has a circular outer surface, and the circular outer surface of the elongated stiffening component contacts the circular inner surface of the shock-absorbing component, wherein from the first end to the second end, the outer skin component encases the outer surface of the shock-absorbing component without leaving any empty spaces between the outer skin component and the outer surface of the shock-absorbing component, from the first end to the second end, the inner surface of the shock-absorbing component encircles the outer surface of the elongated stiffening component without leaving any empty spaces between the inner surface of the shock-absorbing component and the outer surface of the elongated stiffening component, and a length from the first end to the second end is at least 25 inches, the shaft has a uniform thickness from the first end to the second end, and the first end of the lacrosse shaft is adapted to accept a lacrosse head.

2. The shaft of claim 1 wherein the core foam comprises polyurethane.

3. The shaft of claim 1 wherein the core foam comprises extruded polystyrene.

4. The shaft of claim 1 wherein a thickness of the core foam between the outer skin component and the elongated stiffening component is uniform from the first end to the second end.

5. The shaft of claim 1 wherein the elongated stiffening component is a tube having a circular cross section having an empty space within the tube.

6. The shaft of claim 1 wherein the elongated stiffening component is a spar.

7. The shaft of claim 1 wherein the elongated stiffening component has a stress-strain ratio of at least 3.9 pounds per inch at the point of structural failure.

8. The shaft of claim 1 wherein the shaft comprising a combination of the outer skin, shock-absorbing, and elongated stiffening components has the elastic stress-strain rate of at least 5.5 pounds per inch.

9. The shaft of claim 1 wherein the outer skin component further comprises polyamide fibers.

10. The shaft of claim 1 wherein the elongated stiffening component is made of a hollow tube having a wall thickness of at least about 0.01 inches.

11. A lacrosse shaft comprising:

a first end and a second end;

an outer skin component, extending from the first end to the second end, the outer skin component comprising a fabric having fibers extending in at least two directions, the fabric comprising a weave of carbon fibers;

a shock-absorbing component, extending from the first end to the second end, the shock-absorbing component comprising a core foam, wherein the outer skin component encases the shock-absorbing component and is coupled to the shock-absorbing component using an epoxy resin, and the shock-absorbing component has an outer surface and an inner surface, the outer surface being octagonal and the inner surface having an X shape; and an elongated stiffening component, extending from the first end to the second end, the elongated stiffening component comprising unidirectional carbon fiber, wherein the elongated stiffening component has a X-shaped outer surface, and the X-shaped outer surface of the elongated stiffening component contacts the X-shaped inner surface of the shock-absorbing component, wherein the elongated stiffening component has an X-shaped cross section, from the first end to the second end, the outer skin component encases the outer surface of the shock-absorbing component without leaving any empty spaces between the outer skin component and the outer surface of the shock-absorbing component, from the first end to the second end, the inner surface of the shock-absorbing component encases the outer surface of the elongated stiffening component without leaving any empty spaces between the inner surface of the shock-absorbing component and the outer surface of the elongated stiffening component, and a length from the first end to the second end is at least 25 inches, the shaft has a uniform thickness from the first end to the second end, and the first end of the lacrosse shaft is adapted to accept a lacrosse head.

12. The shaft of claim 11 whereby at a point of structural failure, the shaft is capable of breaking without protruding sharp jagged edges at the point of structural failure.

* * * * *